US005704260A

United States Patent [19]

Huang

[11] Patent Number: 5,704,260

[45] Date of Patent: Jan. 6, 1998

[54] SCREW DRIVER HANDLE

[76] Inventor: Yung-Hsu Huang, No. 10, Lane 38, Yii Der Street, Hsin Guang Tsuen, Taiping Hsiang, Taichung Hsien, Taiwan

[21] Appl. No.: 678,561

[22] Filed: Jul. 9, 1996

[51] Int. Cl.[6] ..... B25B 23/16; B25G 1/08

[52] U.S. Cl. ..... 81/177.4; 81/490; 206/378; 206/234; 220/4.22; 220/4.23; 220/324; 220/339

[58] Field of Search ..... 81/490, 177.4, 81/437–439; 206/376–379, 234; 220/4.22, 4.23, 342, 337, 339, 324

[56] References Cited

U.S. PATENT DOCUMENTS 1,309,281 7/1919 Forbes ..... 81/490
2,844,244 7/1958 Hanson ..... 206/379
3,385,422 5/1968 Lowry ..... 220/342 X
4,269,311 5/1981 Rich ..... 81/177.4 X

*Primary Examiner*—D. S. Meislin
*Attorney, Agent, or Firm*—Charles E. Baxley, Esq.

[57] ABSTRACT

A tool handle includes a base and a cap pivotally coupled together at a folding line. The base includes a flange and two punctures and a latch formed in one side edge. The cap includes a groove and two projections and an ear for engaging with the flange and the punctures and the latch of the base such that the cap may be solidly secured to the base. The base includes a number of cavities and holes for partially receiving various kinds of tool bits and for allowing the tool bits to be easily disengaged from the base.

2 Claims, 3 Drawing Sheets

SCREW DRIVER HANDLE

BACKGROUND OF THE INVENTION

1. Field of the Invention

The present invention relates to a handle, and more particularly to a screw driver handle.

2. Description of the Prior Art

Typical screw driver handles comprise a solid configuration having no space provided for receiving other tool bits therein. In order to improve this, a hollow chamber is formed and provided in the handle for receiving various kinds of screw driver bits therein. However, in order to find a correct screw driver bit, the user have to pour all of the screw driver bits out of the handle. This is inconvenient.

The present invention has arisen to mitigate and/or obviate the afore-described disadvantages of the conventional screw driver handles.

SUMMARY OF THE INVENTION

The primary objective of the present invention is to provide a screw driver handle which includes various kinds of cavities formed therein for receiving various kinds of tool bits therein and for allowing the tool bits to be easily found.

In accordance with one aspect of the invention, there is provided a tool handle comprising a base and a cap pivotally coupled together at a folding line, the base including a side edge opposite to the folding line, the side edge of the base including a flange extended upward therefrom and including at least one puncture formed therein and including a latch extended outward therefrom. The cap includes a side edge corresponding to that of the base and opposite to the folding line, the side edge of the cap includes a groove formed therein for engaging with the flange of the base and includes at least one projection extended therefrom for engaging with the puncture of the base and includes an ear having an orifice formed therein for engaging with the latch so as to secure the cap to the base and for allowing the cap to be solidly secured to the base. The base includes a plurality of cavities and a plurality of holes formed therein for partially receiving various kinds of tool bits therein and for allowing the tool bits to be easily disengaged from the base.

The base and the cap each includes a depression located beside the folding line for facilitating a bending of the folding line.

Further objectives and advantages of the present invention will become apparent front a careful reading of a detailed description provided hereinbelow, with appropriate reference to accompanying drawings.

DETAILED DESCRIPTION OF THE PREFERRED EMBODIMENT

Figure 1:
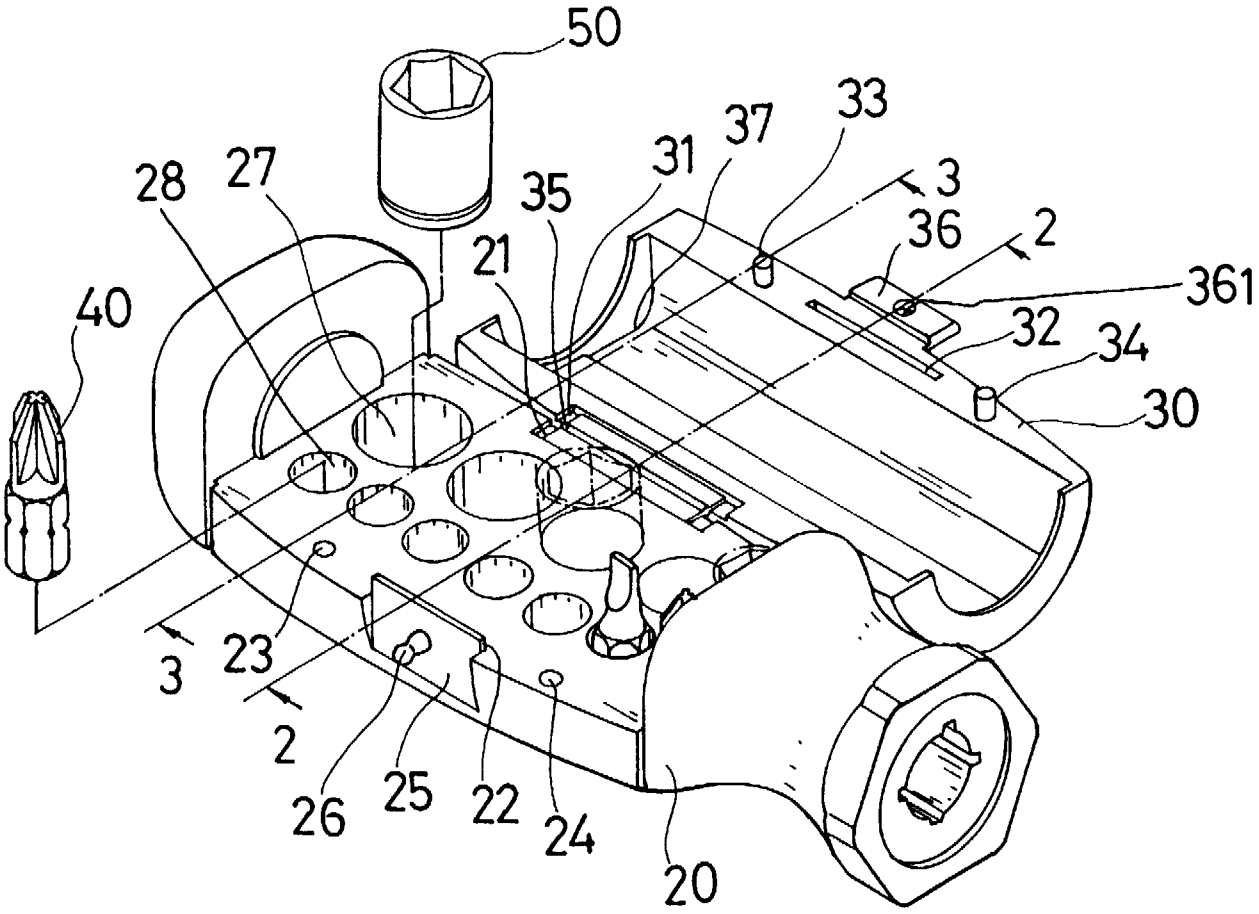
FIG. 1 is a perspective view of a screw driver handle in accordance with the present invention.
Figure 2:
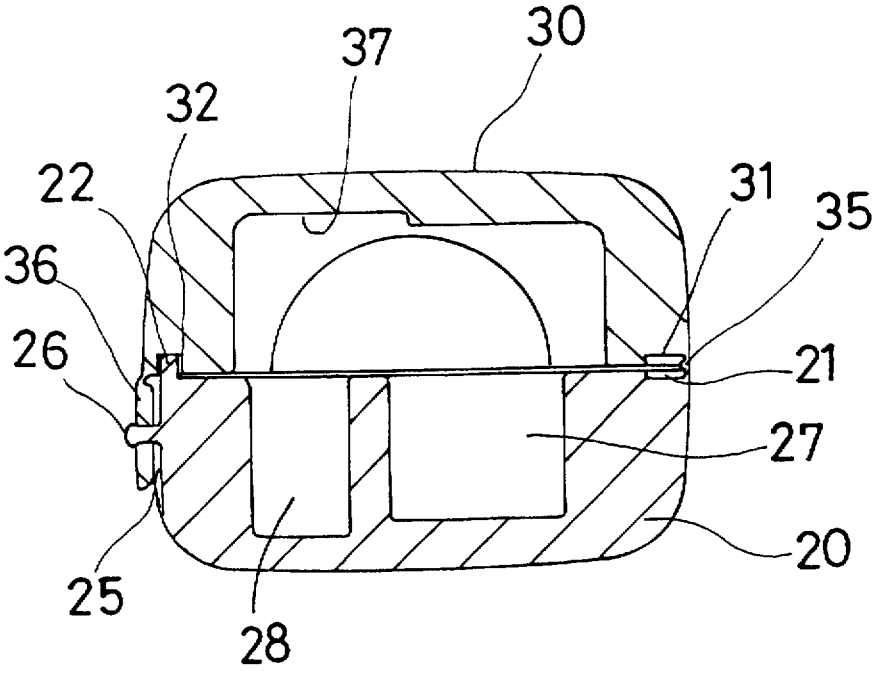
FIG. 2 is a cross sectional view taken along lines 2—2 of FIG. 1.
Figure 4:
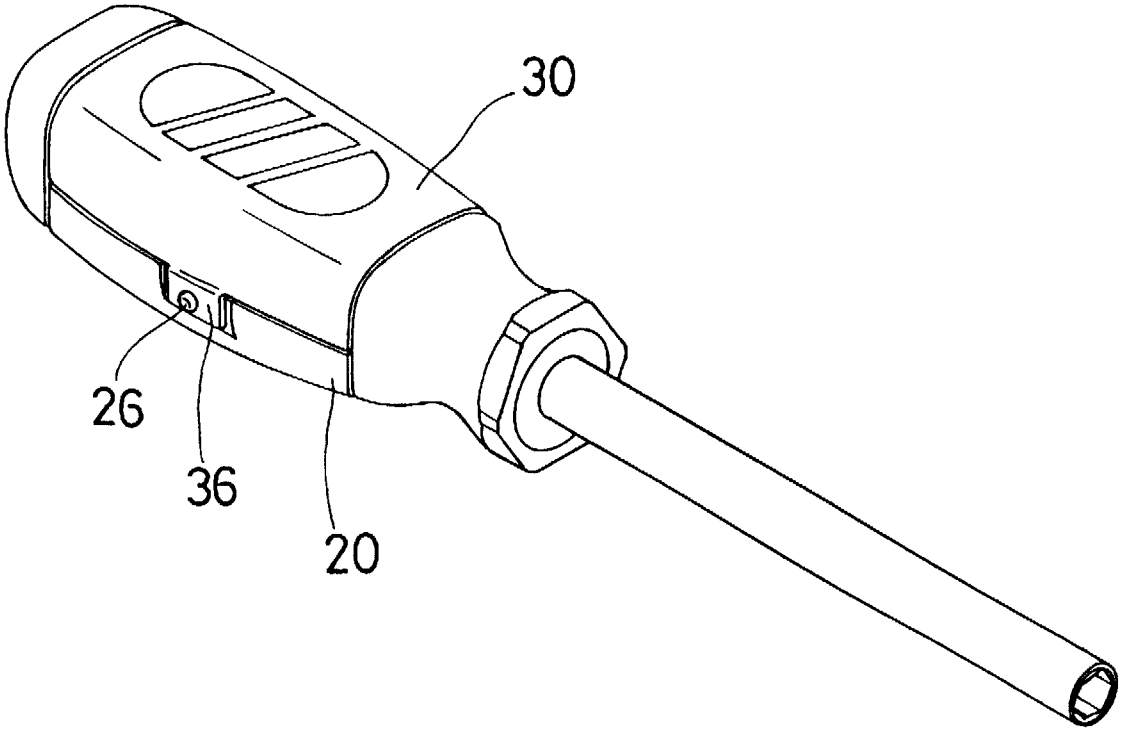
FIG. 4 is a perspective view of the screw driver handle.

Referring to the drawings, and initially to FIGS. 1 and 4, a screw driver handle in accordance with the present invention comprises a base 20 and a cap 30 pivotally coupled together at a folding line 35. The base 20 and the cap 30 each includes a depression 21, 31 formed therein and located beside the folding line 35 for receiving the folding portion of the folding line 35 and for facilitating the bending of the folding line 35 (FIG. 2) and for allowing the handle to include a smooth outer appearance.

Figure 3:
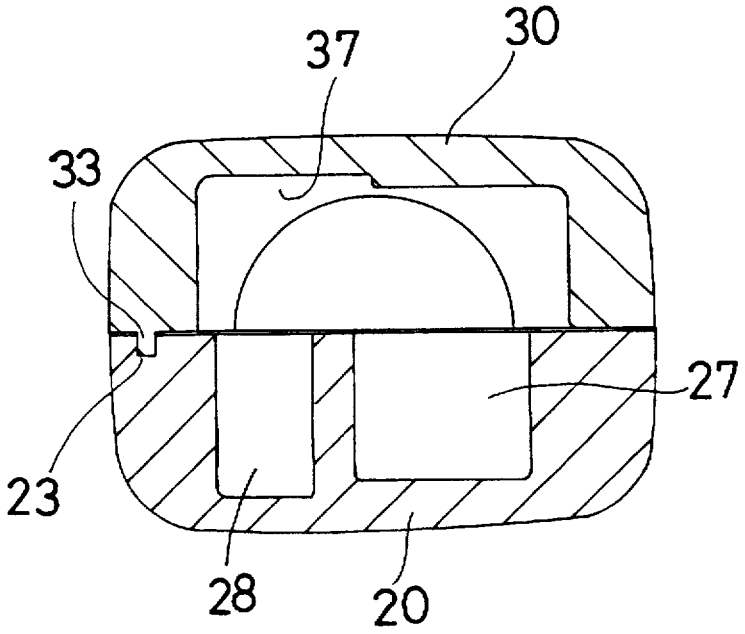
FIG. 3 is a cross sectional view taken along lines 3—3 of FIG. 1.

The base 20 includes a side edge opposite to the folding line 35. The side edge of the base 20 includes a flange 22 extended upward therefrom and includes a tapered surface 25 formed therein and includes two punctures 23, 24 formed therein. A latch 26 is extended outward from the tapered surface 25. The cap 30 includes a side edge corresponding to that of the base 20 and opposite to the folding line 35. The side edge of the cap 30 includes a groove 32 formed therein for engaging with the flange 22 of the base 20 (FIG. 2) and includes two projections 33, 34 extended therefrom for engaging with the punctures 23, 24 of the base 20 (FIG. 3) and includes an ear 36 having an orifice 361 formed therein for engaging with the latch 26 (FIGS. 2 and 4) so as to secure the cap 30 to the base 20. The cap 30 may thus be solidly secured to the base 20 by the engagement between the projections 33, 34 and the punctures 23, 24, and by the engagement between the flange 22 and the groove 32, and by the engagement between the latch 26 and the orifice 361 of the ear 36.

The base 20 includes a number of cavities 27 of larger size formed therein for partially receiving the sockets 50 therein and includes a number of holes 28 of smaller size formed therein for partially receiving the screw driver bits 40 therein. The sockets 50 and the screw driver bits 40 include only the lower portion engaged in the cavities 27 and the holes 28 respectively. The upper portions of the sockets 50 and the screw driver bits 40 are extended outward of the cavities 27 and the holes 28 such that the user may easily fetch the sockets 50 and the screw driver bits 40.

It is to be noted that various kinds of sockets and/or screw driver bits and/or other tool bits may be received in the cavities 27 and/or the holes 28 of the base 20. In addition, the upper portions of the sockets 50 and of the screw driver bits 40 are extended upward beyond the base 20 such that the sockets 50 and the screw driver bits 40 may be easily disengaged from the base 20. The folding line 35 allows the handle to include a smooth outer appearance. It is further to be noted that the handle may be used for storing sockets and couplers for wrenches in addition to the screw driver bits.

Accordingly, the handle in accordance with the present invention includes a cap that may be solidly secured to the base and includes a number of cavities and holes formed in the base for receiving various kinds of the tool bits therein. The tool bits may be easily disengaged from the base.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle comprising:

a base and a cap pivotally coupled together at a folding line, said base including a side edge opposite to said folding line, said side edge of said base including a flange extended upward therefrom and including at least one puncture formed therein and including a latch extended outward therefrom, said cap including a side edge corresponding to that of said base and opposite to said folding line, said side edge of said cap including a groove formed therein for engaging with said flange of said base and including at least one projection extended therefrom for engaging with said puncture of said base and including an ear having an orifice formed therein for engaging with said latch so as to secure said cap to said base and for allowing said cap to be solidly secured to said base, and said base including a plurality of cavities and a plurality of holes formed therein for partially receiving various kinds of tool bits therein and for allowing said tool bits to be easily disengaged from said base.

2. A tool handle according to claim 1, wherein said base and said cap each includes a depression located beside said folding line for facilitating a bending of said folding line.

* * * * *